United States Patent [19]

Luxeder

[11] Patent Number: 4,501,772

[45] Date of Patent: Feb. 26, 1985

[54] PROCESS FOR PRODUCING ULTRA REMOVABLE PRESSURE SENSITIVE LABELS

[76] Inventor: William P. Luxeder, 4171 Mansfield Ave., Akron, Ohio 44319

[21] Appl. No.: 589,997

[22] Filed: Mar. 15, 1984

[51] Int. Cl.[3] ..... B05D 5/10

[52] U.S. Cl. ..... 427/208.6; 427/208.8; 427/209; 427/385.5

[58] Field of Search ..... 427/208.6, 208.8, 209, 427/385.5

[56] References Cited

U.S. PATENT DOCUMENTS

| | | | |
|---|---|---|---|
| 3,035,957 | 5/1962 | Morgan | 154/53.5 |
| 3,785,102 | 1/1974 | Amos | 52/173 |
| 3,967,031 | 6/1976 | Lambert | 428/294 |
| 4,107,811 | 8/1978 | Imsande | 15/215 |
| 4,271,223 | 6/1981 | Lambert et al. | 428/207 |

*Primary Examiner*—Bernard D. Pianalto

*Attorney, Agent, or Firm*—Reese Taylor

[57] ABSTRACT

A method of producing ultra removable paper products having printed matter on at least one surface thereof, comprising the steps of: printing the printed matter on the selected surface or surfaces of the paper by any conventional printing process; applying a coating of non-aqueous varnish to both surfaces of the paper; coating a relief printing plate with a resin bonded fluorocarbon; heating the plate to the curing temperature of the resin bonded fluorocarbon; transferring pressure sensitive adhesive from a suitable reservoir to the relief printing plate; and engaging one surface of the paper with the adhesive so as to transfer a coating of adhesive to the paper.

4 Claims, No Drawings

PROCESS FOR PRODUCING ULTRA REMOVABLE PRESSURE SENSITIVE LABELS

BACKGROUND OF THE INVENTION

This invention relates, in general, to ultra removable pressure sensitive labels of the type intended to be temporarily but securely attached to a supporting surface while being ultimately removable without damage to either the object to which they are attached or to the label itself.

The invention relates, in particular, to a process which enables printers to produce ultra removable pressure sensitive labels utilizing all sizes and types of printing paper and all types and methods of printing with existing equipment with little or no modification thereto and without encountering the problems presented by the presence of a release liner or backing paper.

DESCRIPTION OF THE PRIOR ART

Pressure sensitive adhesive coated labels are, of course, well known in the prior art. These labels have the advantage of being capable of being applied to a supporting surface, such as a product or a package, without the application of any glue or adhesive at the point and time of application.

Generally, these labels comprise a laminate of the label itself with a coating of adhesive on at least one surface and a sheet of release material, which usually takes the form of a fibrous material such as paper, coated with a suitable material, such as silicone, which makes the release material easily removable and covers the adhesive prior to label application. In applying such a label, it is merely necessary then to remove the backing paper and affix the label to the supporting surface or object.

One form of such a label can be seen in Morgan U.S. Pat. No. 3,035,957 wherein a label having a protective backing is temporarily secured to the adhesive coating and wherein embrittled areas are provided so that the backing can be ruptured to facilitate easy removal.

Labels of various types have also been developed wherein pads of labels or materials have been produced with pressure sensitive adhesive wherein the same are capable of being assembled in pad form with printing thereon. Moderately tacky adhesive is usually applied to one side only and the sheets can then be removed from the pads for their ultimate use. Of general interest in the related patent prior art are Imsande U.S. Pat. No. 4,107,811 and Amos U.S. Pat. No. 3,785,102.

Lambert U.S. Pat. No. 4,271,223 is also of interest wherein the label stock, per se, comprises a plastic film material which is printable. Lambert U.S. Pat. No. 3,967,031 is also of interest, being directed to a tape of polymeric material, such as PVC or biaxially oriented polyethylene terephthalate (MYLAR), coated with an adhesive and which is manufactured and sold in roll form with the basic object being to backsize the coating to protect the printing appearing on the tape.

One of the difficulties with most of the prior art of this general type is that the printer is limited by the selection of paper sizes and finishes utilized by the adhesive manufacturer. The printer also, in some of the prior art, has to contend with the release liner or backing material and high fidelity, four color process lithographic labels have consequently been difficult to manufacture. Also where splits or embrittled areas are employed to facilitate removal of the backing, the printing process is impaired since voids are created in those areas during printing.

Still another difficulty is that temperature changes, at times, cause the backing paper to shift, resulting in a misregister of the image being formed by the printing process.

Even where the release paper is eliminated and only a moderately tacky adhesive is used, difficulty is still encountered during the printing process since the adhesive adds a sponginess to the paper and a consistent dot pattern is difficult to maintain.

SUMMARY OF THE INVENTION

The present invention has, as its primary object, the provision of a process whereby ultra removable pressure sensitive printed labels can be produced without restrictions on paper size, color, or finish, and with existing equipment commonly found in printing companies with little or no modification of the same.

In accomplishing this object, the present invention involves a process which includes the following steps:

- printing the printed matter on a selected surface or surfaces of conventional paper by any conventional printing process;
- applying a coating of non-aqueous varnish to both surfaces of the paper;
- coating a relief printing plate with a resin bonded fluorocarbon;
- heating the plate to the curing temperature of the resin bonded fluorocarbon;
- transferring pressure sensitive adhesive from a suitable reservoir to the relief printing plate; and
- contacting one surface of the paper with the adhesive so as to transfer a coating of adhesive to the paper.

It is believed that the steps of the method which are particularly novel include varnishing the paper following printing and prior to application of the adhesive and coating the block or printing plate with the fluorocarbon prior to application of the adhesive.

Accordingly, production of an improved process of the character above-described becomes the principal object of this invention with other objects thereof becoming more apparent upon a reading of the following brief specification.

BRIEF DESCRIPTION OF THE PREFERRED EMBODIMENT

In carrying out the process of the present invention, the first step is to obtain a standard printing plate, such as either a high or shallow relief printing plate commonly made of copper, zinc, rubber, or some other polymeric material. The choice of plate material is based on economics and on the actual method employed to transfer the image onto the paper stock with the present process being effective with most known plates.

In preparing the printing plate, the material used must be thoroughly cleaned and dried and then coated with a resin bonded fluorocarbon and heated to a sufficient temperature to cure the fluorocarbon but not hot enough to melt the base material of the plate.

The precise curing temperatures employed would, of course, be dictated substantially by the type of fluorocarbon material being used for coating the printing plate.

Once the plate has been prepared, the next step in the process is to insert the paper into the printing apparatus.

In this regard, the printing apparatus which can be employed in practicing the method of this invention is intended to include any conventional printing device, such as a letterpress, offset lithography, rotogravure, or silk screen. Transfer of the image to be applied to the paper is carried out in conventional fashion and, in the preferred form of the invention, would be applied to one surface only of the paper although, in some applications, both surfaces could be printed if desired.

Once the images have been transferred to the selected surface of the paper, a coating of non-aqueous varnish can be applied to both surfaces. This varnish is readily available and well known in the printing art and will be described below. On the backside, or the side opposite the printed matter, a sealer type varnish is applied and is intended to seal the fibers of the paper from taking on or being penetrated by the water in the water soluble adhesive which will subsequently be applied.

With much of the stock commonly used for labels of this type, if this is not done, the water from the adhesive tends to create a puckering or dimpled effect effectively creating depressions in the stock which require additional adhesive and which also are detrimental to the appearance on the printed side of the label. However, it should be noted that in some applications, if the stock or paper is thick enough, this step would not be required.

As noted, a coating of non-aqueous varnish, such as the type manufactured by Braden Sutphin Ink Company, of Cleveland, Ohio, and identified as 201V2646, is applied to the printed surface. This is essentially adhesive resistant, flat, overprint varnish of a type well known in the printing art. The object here is to protect the printed side when the adhesive side of the next adjacent label is placed against it in the padding arrangement, as will be described.

The next step is to transfer pressure sensitive adhesive from a suitable reservoir to the printing plate which, as noted above, has been coated with the resin bonded fluorocarbon. The thickness of the adhesive layer is approximately 0.001 inches, although it will be understood that some variation is possible. It should also be noted here that the adhesive material applied to the printing plate should not cover the entire surface. Preferably, a corner area or some other, relatively small area, will be left free of adhesive to enable the labels to be peeled off the pad which is subsequently formed or off the substrate to which it may be secured.

Once the relief printing plate, which has a raised pattern such as a waffle or grid type pattern of ribs and depressions in it, has been thus coated, the adhesive is transferred from the plate to the reverse surface of the paper. It will be understood that the invention is not intended to be limited to any particular pattern but it has been found that some sort of noncontinuous surface is desirable to facilitate removal of material.

In one example of the utilization of the concept of the invention, copper, zinc, and rubber printing plates were first acetone cleaned and the copper and plastic parts were etched with DEOX®, rinsed, and thoroughly dried before coating. DEOX is a trademark of National Chemsearch of Irving, Tex., for its cleaner and descaling material. Other suitable cleaning agents could also be used.

The plates were then coated with a fluorocarbon coating of Number 310 EMRALON®. EMRALON is a liquid phenolic, resin-bonded PTFE coating and lubricant having an excellent surface adhesion and providing a low coefficient of friction, corrosion resistance, and good release properties. EMRALON is a registered trademark of Acheson Colloids Company, of Port Huron, Mich. The material has a low temperature cure of 300° F., a friction coefficient of between 0.05–0.07, a service temperature of 350° F., an intermittent temperature of 400° F., and a flash point of 46° F. The material can be and should be applied by a spray technique. It has also been found that EMRALON 311, having similar characteristics, can also be employed as can other fluorocarbon coatings having similar properties.

Once a suitable fluorocarbon, as just described, is applied to the plate and cured, the plate is ready for receipt of the adhesive.

The adhesive composition employed in this invention essentially has a base of HYCAR® 26146, which is an inherently pressure sensitive acrylic latex polymer produced by the B. F. Goodrich Company, Chemical Group having an optimized balance of adhesive and cohesive strength.

HYCAR® 26146 has the following typical properties:

| | |
|---|---|
| pH | 7.3 |
| Total Solids (%) | 50.0 |
| Brookfield Viscosity (Centipoises Spindal No. 2, 60 rpm) | 100.0 |
| Surface Tension (Dynes/Cm.) | 44.0 |
| Specific Gravity: Latex | 0.99 |
| Glass Transition Temperature (°C.) | −55.0 |

The HYCAR® is mixed with two other components.

One of these components is COVINAX 169, which is a pressure sensitive vinyl acrylic water based emulsion copolymer exhibiting very aggressive wet and dry tack, manufactured by The Franklin Chemical Company, of Columbus, Ohio. This material has the following emulsion properties:

| | |
|---|---|
| Polymer Type | Vinyl Acrylic |
| Colloid | Polyvinyl Alcohol |
| Viscosity | 2,400–3,000 CPS |
| Solids | 58–60% |
| pH | 4.0–5.5 |
| Borax Compatible | No |
| Weight Per Gallon | 8.5 lbs. |
| Mechanical Stability | Excellent |
| Freeze-Thaw Stability | Poor |

Finally, a thickener is added to the HYCAR® and COVINAX and, in this example, the thickener employed was VERSA-TL® solution. VERSA-TL® is an anionic polyelectrolyte of sodium polystyrene sulfonate usable as a dispersant for metal oxides and sulfates, as a suspending agent for selected particulates and to provide viscosity control in aqueous adhesive systems. VERSA-TL® is a trademark of Proctor Chemical Company, Inc., of Bridgewater, N.J., having the following typical properties:

| | |
|---|---|
| Appearance | tan powder |
| Odor | slight pungent order |
| Solubility | soluble in water and lower glycols |
| DTA* | 460° C. |
| pH | 4–8 |
| Bulk Density | 26 lbs/ft$^3$ |
| Type | anionic |

-continued

| | |
|---|---|
| Moisture | 6% maximum |

*DTA — Differential Thermal Analysis

In the example being discussed, the proportions by weight are as follows:

| | |
|---|---|
| HYCAR ® | 80% |
| COVINAX 169 | 15% |
| VERSAL-TL ® | 5% |

Once the adhesive has been formulated, it is then transferred to a reservoir suitably located so that it can readily be transferred to the relief printing plate which, as described above, has been coated with the resin bonded fluorocarbon. Once the adhesive is transferred to the printing plate, it can then be subsequently transferred to the surface of the paper to be coated.

It should be noted that in some printing operations, it may be necessary to include a slight modification of the normal printing equipment.

In a letter press operation, for example, the form rollers and vibrators which normally transfer ink from the ink fountain should be coated with the resin bonded fluorocarbon as should the ink fountain to facilitate cleaning. The receiving end of the press will have to be extended and, in some instances, an oven with a conveyor will be installed. This oven would be of the same width as the maximum width of the press, i.e., long enough to dry and evaporate the water in the adhesive. In other applications, such as in letterpress apparatus having a chain drive which grasps the paper, it may merely be necessary to add links to the chain to extend it.

After cure of the adhesive, the finished sheets are then advanced the full length of the platform by conventional means such as grippers or paddles, for example, before being released and the adhesive coated sheets are then disposed in a stack or pad for such further disposition as is required.

In any event, after the printing and adhesive application steps have been completed, the stock can be cut to size by using a guillotine cutter or die cut using high die, automatic, or semiautomatic equipment.

While a full and complete description of the invention has been set forth in accordance with the dictates of the Patent Statutes, it should be understood that modifications can be resorted to without departing from the spirit hereof or the scope of the appended claims.

Thus, while certain specific commercially available materials have been referred to herein by way of example, it will be understood that other components having similar physical properties could be employed, with undue experimentation, in carrying out the method. Also, while Applicant has set forth, by way of example, an adhesive composition, it will be understood that such composition represents the preferred composition only.

What is claimed is:

1. A method of producing ultra removable paper products having printed matter on at least one surface thereof, comprising the steps of:

(A) printing the printed matter on the selected surface or surfaces of the paper by any conventional printing process;

(B) applying a coating of non-aqueous varnish to both surfaces of the paper;

(C) coating a relief printing plate with a resin bonded fluorocarbon;

(D) heating the plate to the curing temperature of the resin bonded fluorocarbon;

(E) transferring pressure sensitive adhesive from a suitable reservoir to the relief printing plate; and (F) engaging one surface of the paper with the adhesive so as to transfer a coating of adhesive to the paper.

2. The method of claim 1 wherein the fluorocarbon coated surface of said relief printing plate has a noncontinuous surface area.

3. The method of claim 1 wherein said pressure sensitive adhesive is applied to less than the entire surface of said printing plate and said paper.

4. The method of claim 1 wherein said pressure sensitive adhesive includes a pressure sensitive acrylic latex polymer, a pressure sensitive vinyl acrylic emulsion copolymer, and an anionic polyelectrolyte of sodium polystyrene sulfonate.

* * * * *